United States Patent [19]

Okutomi et al.

[11] 4,129,761

[45] Dec. 12, 1978

[54] VACUUM CIRCUIT BREAKER

[75] Inventors: Tsutomu Okutomi, Kawasaki; Hisashi Yoshino; Seishi Chiba, both of Yokohama; Tadahito Tsutsumi, Fujisawa; Kouichi Tejima, Tokyo, all of Japan

[73] Assignee: Tokyo Shibaura Electric Co., Ltd., Kanagawa, Japan

[21] Appl. No.: 801,218

[22] Filed: May 27, 1977

[30] Foreign Application Priority Data

May 27, 1976 [JP] Japan ..... 51-60603

[51] Int. Cl.[2] ..... H01H 33/66

[52] U.S. Cl. ..... 200/144 B; 200/262; 200/266

[58] Field of Search ..... 200/144 B, 262, 265, 200/266

[56] References Cited

U.S. PATENT DOCUMENTS

| | | | |
|---|---|---|---|
| 2,975,256 | 3/1961 | Lee et al. | 200/144 B |
| 3,497,652 | 2/1970 | Horn et al. | 200/144 B |
| 3,551,622 | 12/1970 | Takeuchi et al. | 200/144 B |
| 3,770,497 | 11/1973 | Hassler et al. | 200/266 |

FOREIGN PATENT DOCUMENTS

| | | | |
|---|---|---|---|
| 1025944 | 4/1966 | United Kingdom | 200/144 B |

*Primary Examiner*—Robert S. Macon

*Attorney, Agent, or Firm*—Oblon, Fisher, Spivak, McClelland & Maier

[57] ABSTRACT

A vacuum circuit breaker comprising an evacuated envelope and a pair of movable conductive rods within the envelope having points of contact equipped with contact members, wherein the conductive rods slide into and out of engaging contact, the improvement comprising at least one of said contacts having circuit making and breaking contact members formed of an alloy consisting essentially of 9.4 wt% to 15 wt% Al, 4.5 wt% to 20 wt% Ni, 0.1 wt% to 10 wt% of at least one metal (Me) selected from the group consisting of bismuth, tellurium, selenium, antimony and magnesium with copper as the balance of the alloy, wherein said alloy contains an $\alpha$ copper phase (Cu($\alpha$)) containing nickel and a $\gamma$ copper phase (Cu($\gamma$)) containing nickel substantially dispersed throughout said alloy.

2 Claims, 2 Drawing Figures

VACUUM CIRCUIT BREAKER

BACKGROUND OF THE INVENTION

1. Field of the Invention

The present invention relates to a vacuum circuit breaker and, more particularly, to a contact structure for such a breaker.

2. Description of the Prior Art

Generally, the vacuum circuit breakers have three basic requirements which must be met. The first of these is that the circuit breaker must be capable of momentarily carrying current and closing against momentary current loads substantially in excess of the rated current capacity of the breaker without producing objectionable weld spots between the contacts of the breaker and without otherwise damaging the contacts of the breaker. The second requirement is that the breaker must be capable of breaking a current when overloaded. The third requirement is that the circuit breaker must be capable of withstanding, without damage or a disruptive discharge, an impulse crest voltage and a continuous A.C. voltage at the rated voltage of the device. J. W. Porter et al., in U.S. Pat. No. 3,497,652, have proposed that the contacts of a vacuum breaker be formed of an alloy consisting of copper - aluminum - bismuth. Vacuum breakers which have contacts of these alloys can interrupt high inductive currents at rated voltages, can carry currents and close against such currents without producing objectionable contact-welds between the contacts, and can successfully withstand high impulse crest voltages of at least 95 KV and continuous 60 cycle voltages of at least 36 KV r.m.s. when the contacts are fully separated. Although such contacts are entirely satisfactory for many circuit applications, vacuum breakers whose contacts are formed of contact making and breaking regions of copper - aluminum - bismuth alloys as disclosed in the above-described patent have not been able to meet certain mechanical requirements. For instance, a mechanical property of vacuum breakers relates to the tendency of contacts to fracture by the application of an external mechanical force which is applied many times thereby interrupting the operation of the device through transient operations as well as when a thermal force is imparted to the contacts and contact base when a device containing such contacts is used in welding processes thereby being subjected to heat ranging from 600°-800° C. Contact containing devices also encounter high temperatures of 400°-600° C. employed in baking processes. Also, mechanical stress is imparted to such contact containing devices when cooled. Moreover, during manufacture of the vacuum breakers, the contacts exhibit the embrittlement phenomenon which reduces the eutectic modification of the alloy from the $\beta$ phase to the $\alpha+\gamma$ phase as the central structural feature of the natural alloy. The $\alpha+\gamma$ phase contains a compound which embrittles the $\gamma$ phase and which is coarse and reaches a length of 1000 $\mu$m and a width more than 100 $\mu$m.

A need, therefore, continues to exist for an alloy material for vacuum circuit breakers whose contact points exhibit favorable mechanical characteristics.

SUMMARY OF THE INVENTION

Accordingly, one object of the present invention is to provide a vacuum breaker which has improved mechanical properties such as the ability to withstand the impacts of external forces without exhibiting deterioration of the voltage stress values during the contact-separation aspect of the operation of the breaker device.

Another object is to provide vacuum breaker contacts which do not exhibit embrittlement characteristics which normally emerge when the contacts are subjected to heat treatment process during manufacture of electrodes such as in soldering or baking.

Another object is to provide a vacuum circuit breaker which has a large current capacity which can be easily manufactured.

Briefly, these objects and other objects of the present invention as hereinafter will become more readily apparent can be attained by a vacuum circuit breaker comprising an evacuated envelope and a pair of movable conductive rods within the envelope having points of contact equipped with contact members, wherein the conductive rods slide into and out of engaging contact, the improvement comprising at least one of said contacts having circuit making and breaking contact members formed of an alloy consisting essentially of 9.4 wt % to 15 wt % Al, 4.5 wt % to 20 wt % Ni, 0.1 wt % to 10 wt % of at least one metal (Me) selected from the group consisting of bismuth, tellurium, selenium, antimony and magnesium with copper as the balance of the alloy, wherein said alloy contains an $\alpha$ copper phase (Cu($\alpha$)) containing nickel and a $\gamma$ copper phase (Cu($\gamma$)) containing nickel substantially dispersed throughout said alloy.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
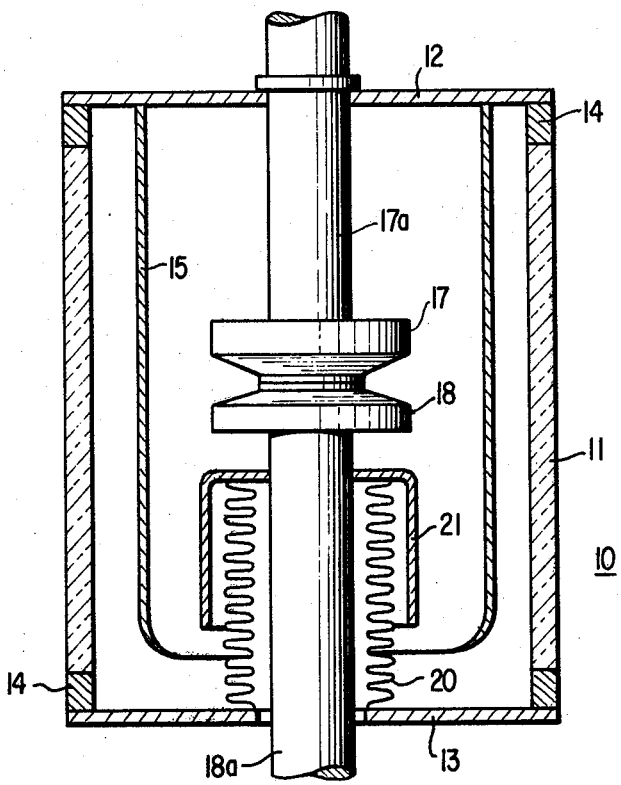
FIG. 1 is a sectional view of a vacuum circuit breaker which embodies one form of the present invention.

Referring now to the breaker of FIG. 1, a highly evacuated envelope 10 is shown which comprises a casing 11 of a suitable insulating material such as glass, and a pair of metallic end caps 12 and 13 which close off the ends of the casing. Suitable seals 14 are provided between the end caps and the casing 11 which render the envelope 10 vacuum-tight. The normal pressure within the envelope 10 under static conditions is less than $10^{-4}$ mmHg, preferably between $10^{-4}$ mmHg and $10^{-8}$ mmHg, so that it can be reasonably assured that the mean free path for electrons will be longer than the potential breakdown paths in the envelope.

The internal insulating surfaces of casing 11 are protected from the condensation of arc-generated metal vapors thereon by means of a tubular metallic shield 15 suitably supported on end cap 12 and preferably isolated from the end cap 13. This shield acts in a well-known manner to intercept arc-generated metallic vapors before they can reach casing 11.

Located within the envelope 10 is a pair of separable contacts 17 and 18, which are shown in an engaged or closed-circuit position. The upper contact 17 is a stationary contact suitably attached to a conductive rod 17*a*, which at its upper end is united to the upper end cap 12. The lower contact 18 is a movable contact which is joined to a conductive operating rod 18a which is suitably mounted for vertical movement. Downward motion of contact 18 separates the contacts and opens the breaker, whereas the opposite return movement of contact 18 reengages the contacts and thus closes the breaker. A typical length of the gap of separation when the contacts are fully-open is about 20 mm. The operating rod 18a projects through an opening in the lower end cap 13, and a flexible metallic bellows 20 provides a seal about the rod 18a to allow for vertical movement of the rod without impairing the vacuum inside the envelope 10. Metallic bellows 20 are suitably supported by metallic shield 21. As shown in FIG. 1, the bellows 20 are secured in a sealed relationship at their respective opposite ends to the operating rod 18a and the lower end cap 13.

Figure 2:
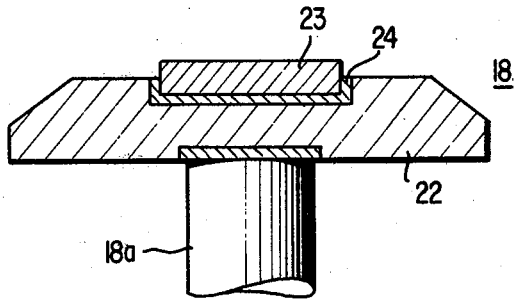
FIG. 2 is an enlarged perspective view of one of the contacts of the breaker of FIG. 1.

The configuration of the contacts of the present invention is not critical and is not limited to any particular contact configuration. For example, as shown in FIG. 2, contact 18 is constructed of a disc shaped base 22 which is soldered on the end of rod 18a and which has a contact member 23 on its major surface facing the opposing contact. The central region of each contact member 23 is fixed in base 22 by solder 24. The circuit-making and breaking surfaces abut against each other when the contacts are in their closed position, and possess surface features which allow the ready flow of current through the closed contacts.

The alloy used in the vacuum breaker contacts of the present invention consists of copper (Cu) - aluminum (Al) - nickel (Ni) - and a metal (Me) which is at least one metal selected from the group of bismuth (Bi), tellurium (Te), selenium (Se), antimony (Sb), and magnesium (Mg). The composition of the alloy contains from 9.4% to 15% Al, from 4.5% to 20% Ni, from 0.1% to 10% Me and the balance Cu. (The percentage figures are weight percent).

The alloy for the breaker contacts can be prepared by melting the Cu, Al and Ni constituents and mixing the elements while molten under vacuum conditions of about $10^{-5}$ mmHg and a temperature of about 1200° C. After the molten Me metal is added to the molten mixture of Cu - Al - Ni under an argon gas atmosphere, the temperature is decreased to allow the mass to cool which causes the constituents to solidify into a cast form and form the solid alloy. The alloy obtained by the procedure contains a precipitation phase which is formed of a Cu(α) phase containing Ni and a Cu(γ) phase containing Ni.

Having generally described this invention, a further understanding can be obtained by reference to certain specific examples which are provided herein for purposes of illustration only and are not intended to be limiting unless otherwise specified.

EXAMPLE

The measured results of aspects and properties of an alloy within the scope of the present invention are shown in Table 1 in comparison to a conventional alloy.

Table 1

| | aspects and properties of the alloy of the present invention | conventional alloy |
|---|---|---|
| amounts of constituents in alloy | Cu-13Al-9Ni-0.5Bi | Cu-13Al-0.5Bi |
| precipitation phase | Cu(α) containing Ni + Cu(γ) containing Ni | Cu(α) + Cu(γ) |
| mode of precipitation | finely and uniformity dispersion | continuous phase |
| width of precipitation phase | ≦ 1 μm | ≧ 100 μm |
| length of precipitation phase | 1 to 100 μm | 100 to 2000 μm |
| voltage stress (KV) immediately after casting | 66 - 68 | 54 - 58 |
| voltage stress (KV) after performing the contacting operation 30 times | 64 - 68 | 48 - 58 |
| contact resistance (Ω) before silver soldering treatment | 0.5 | 0.5 |
| contaminated portion | 28% | 79% |
| mean value of contact resistance (Ω) without contaminated portion | 4 | 72 |

The measured values of voltage stress shown in Table 1 are the voltages of the spark generated by gradually increasing the applied voltage between a positive electrode of a nickel needle which is polished to a mirror-like finish by buffing, and a contact formed of the alloy shown in Table 1 as the negative electrode which has a mirror-like finish. The electrodes were spaced at a gap length of 0.5 mm.

It is apparent from the data in Table 1 that the contacts of the breaker of the present invention have an excellent ability to form a finely precipitated sludge which consists of a Cu(α) phase containing Ni and a Cu(γ) phase containing Ni in the alloy. Referring to Table 1 it is evident that as a result of the finely precipitated sludge structure of the present alloy, the alloy, immediately after it is casted, exhibits a narrow fluctuation in the voltage stress. After the contact has been operated 30 times, the range of voltage stress fluctuation remains relatively narrow. Thus, it is rare when contacts formed from the alloy of the present invention exhibit significant fluctuations in the stress voltage characteristic after repeated operations of the contacts.

In manufacturing the vacuum breaker, the surfaces of the contacts can accumulate contaminates as a result of environmental conditions during the manufacturing process such as the type of ingot making process employed to the many types of possible processes for producing the products. For example, when a contact member is soldered to the electrode base by silver soldering, and then it is heated to 800° C. under hydrogen, and thereafter cooled to 60° C. and then exposed to the air, contamination of the surface of the contact results. There is very little difference in contact resistance between the pre-soldered state and after soldered state of the contact. Accordingly, it has been found that the surfaces of the contacts of the present invention in comparison to the conventional contacts are not as susceptable to contamination.

Generally, the gas content of the alloy from which the contacts of the breakers are formed is a factor which has an important influence on the interrupting ability and the voltage stress ability of the breakers. Thus, when the amount of internal gas in the vacuum circuit breaker is increased by gases which escape from the alloy of the breaker, reignition or rearcing of the breaker occurs because of the decreased vacuum within the breaker. This is shown by the data in Table 2 which contrasts an alloy of the present invention with a conventional alloy.

Table 2

| | Properties of an alloy of the present invention | conventional alloy |
|---|---|---|
| quantity of the internal gas in the alloy | 3 to 4 ppm | 6 to 10 ppm |
| quantity of the internal gas in the alloy with absorbed gas | 15 to 20 ppm | 20 to 40 ppm |
| change (deterioration) of the vacuum in the breaker when immediately operated at an interrupting voltage of 20 KV | scarcely changed | changed from $10^{-8}$ mmHg to $10^{-6}$ mmHg |
| number of times reignited | did not occur | reignited 1-2 times during 50 times of operation |

ufacturing process for the contacts and the tensile stress is too low. If the quantity of nickel is increased beyond 20% by weight, the electrical conductivity of the alloy decreases and it is difficult to achieve a device of a large capacity. If the quantity of Me is outside of the range of 0.1% to 10% by weight, the desired weld-resistance ability of the alloy cannot be obtained and the breaking ability of the device decreases. Table 3 shows various physical characteristics of several alloys within the scope of the present invention in comparison to a conventional alloy composition and some control compositions. The voltage stress and weld-resistance ability test data in Table 3 were obtained after the alloy contacts underwent 10 repetitive tests. The weld-resistance ability of the alloy is indicated by the force required to separate contacts which have been forced cold-welded together with 100 Kg of force, and then to which was applied a D.C. voltage of 100 Volts.

If desired, a portion of the Ni in the Cu - Al - Ni - Me alloy may be substituted by Fe although the distribution value of the voltage stress and the contact-resistance becomes narrow. However, if the added quantity of iron is reduced below about 0.1% by weight by total amount, these detrimental effects do not occur. If the quantity of iron is increased beyond about 5% by weight, segregation occurs in the alloy.

Table 3

| | | Alloy composition of the present invention | | | conventional alloy | Control alloy | |
|---|---|---|---|---|---|---|---|
| | | Example-1 | Example-2 | Example-3 | | Control-1 | Control-2 |
| constituents (weight percent) | Al | 13.0 | 10.6 | 14.4 | 13.0 | 3.2 | 16.4 |
| | Ni | 9.0 | 9.1 | 9.0 | — | 9.2 | 9.0 |
| | Me(Bi) | 0.5 | 0.4 | 0.3 | 0.5 | 0.4 | 0.3 |
| | Cu | bal. | bal. | bal. | bal. | bal. | bal. |
| voltage stress (KV) | | 66–68 | 58–60 | 64–68 | 54–58 | 45–50 | 57–60 |
| weld-resistance (Kg) | | 0–10 | 0–20 | 1–20 | 0–5 | 20–50 | 10–20 |
| Vicker's hardness (Hv) | | 270 | 270 | 270 | 310 | | |
| elongation (%) | | 4.8 | 4.8 | 4.8 | 0.8 | | |
| tensile stress (Kg/mm$^2$) | | 65 | 65 | 65 | 22 | | |
| electric conductivity (% ICAS) | | 14 | 14 | 14 | 15 | | |

Accordingly, the breaker of the present invention does not exhibit significant changes in performance characteristics during the contact-making and breaking modes of the breaker, and therefore exhibits very stable operating characteristics. In the preparation of the present alloy the viscosity of the molten metal during manufacture of the alloy decreases. Consequently, the speed of diffusion of trapped gases increases in the preparation of the contact. Accordingly, the alloy contact of the present invention exhibits very good degassing characteristics because of the small amount of gas in the alloy.

The compositions of the alloy used in the breaker of this invention embraces an aluminum content of 9.4% to 15% by weight, a nickel content of 4.5% to 20% by weight, a metal (Me) content of at least one metal selected from the group of bismuth, tellurium, selenium, antimony and magnesium, ranging from 0.1% to 10% by weight with the balance copper. The composition contains a substantially dispersed alpha phase of copper (Cu($\alpha$)) containing nickel and a gamma phase of copper (Cu($\gamma$)) containing nickel. If the quantity of aluminum is reduced below 9.4% by weight, the weld-resistance ability of the contacts is inferior. If the quantity of aluminum is increased beyond 15% by weight, the weld resistance ability of the alloy is inferior. Moreover, embrittlement becomes a problem. If the quantity of nickel is reduced below 4.5% by weight, the Vickers' hardness becomes too hard and increases above 300. Moreover, it is difficult to maintain an economical man-

Having now fully described this invention, it will be apparent to one of ordinary skill in the art that many changes and modifications can be made thereto without departing from the spirit or scope of the invention as set forth herein.

What is claimed as new and intended to be secured by Letters Patent is:

1. In a vacuum circuit breaker comprising an evacuated envelope and a pair of movable conductive rods within said envelope having points of contact equipped with contact members, wherein said conductive rods therefore are movable into and out of engaging contact, the improvement comprising:

at least one of said contacts having circuit making and breaking contact members formed of an alloy consisting essentially of 9.4wt % to 15 wt % Al, 4.5 wt % to 20 wt % Ni, 0.1 wt % to 10 wt % of at least one metal (Me) selected from the group consisting of bismuth, tellurium, selenium, antimony and magnesium with copper as the balance of the alloy, wherein said alloy contains an $\alpha$ copper phase (Cu($\alpha$)) containing nickel and a $\gamma$ copper phase (Cu($\gamma$)) containing nickel substantially dispersed throughout said alloy.

2. The vacuum circuit breaker of claim 1, wherein said nickel in said alloy is substituted by from 0.1 wt % to 5 wt % iron.

* * * * *